US008071917B2

(12) United States Patent
Franzolin

(10) Patent No.: US 8,071,917 B2
(45) Date of Patent: Dec. 6, 2011

(54) COOKING OVEN FOR FOODS WITH VARIABLE SPEED ELECTRIC FAN AND DEVICE FOR REGULATING THE SPEED WITH HEAT RECOVERY

(75) Inventor: Enrico Franzolin, Vigodarzere (IT)

(73) Assignee: Unox S.p.A., Vigodarzere (PD) (IT)

( * ) Notice: Subject to any disclaimer, the term of this patent is extended or adjusted under 35 U.S.C. 154(b) by 99 days.

(21) Appl. No.: 12/761,870

(22) Filed: Apr. 16, 2010

(65) Prior Publication Data

US 2010/0270283 A1 Oct. 28, 2010

(30) Foreign Application Priority Data

Apr. 22, 2009 (IT) ..... PD2009A000103

(51) Int. Cl.
*F24C 15/32* (2006.01)
*A21B 1/26* (2006.01)
*A21B 1/40* (2006.01)

(52) U.S. Cl. ..... 219/400; 219/413; 126/21 A

(58) Field of Classification Search ..... None
See application file for complete search history.

(56) References Cited

U.S. PATENT DOCUMENTS

| | | | | |
|---|---|---|---|---|
| 3,614,388 | A | 10/1971 | Robinson | |
| 4,191,875 | A * | 3/1980 | Cunningham | 219/623 |
| 5,859,581 | A * | 1/1999 | Morris | 338/50 |
| 2005/0155598 | A1 * | 7/2005 | Berti | 126/39 BA |

FOREIGN PATENT DOCUMENTS

| | | | |
|---|---|---|---|
| DE | 2657929 | A * | 6/1978 |
| DE | 3116183 | A1 * | 11/1982 |

* cited by examiner

*Primary Examiner* — Joseph M Pelham
(74) *Attorney, Agent, or Firm* — Volpe and Koenig, P.C.

(57) ABSTRACT

A cooking oven for foods is described, comprising a cooking chamber, a variable speed electric fan arranged for generating forced ventilation of the air inside the chamber, a regulating system for regulating the speed of the motor of the electric fan including at least one resistive electric element in the electrical supply circuit of the motor, in order to obtain the variation of the speed of the fan as a result of the electrical supply of the resistive element, wherein the resistive element is provided inside the cooking chamber of the oven, so that the heat generated by the resistive element is recovered and maintained within the cooking chamber in the thermal balance of the chamber, during the cooking of the foods.

5 Claims, 1 Drawing Sheet

COOKING OVEN FOR FOODS WITH VARIABLE SPEED ELECTRIC FAN AND DEVICE FOR REGULATING THE SPEED WITH HEAT RECOVERY

FIELD OF INVENTION

The present invention relates to a cooking oven for foods with a variable speed electric fan.

BACKGROUND

In the technical sector in question, in particular in the field of cooking ovens for foods, apparatuses are widely used which are equipped with fans acting within the cooking chambers and capable of providing forced air circulation, necessary for adequately ensuring the process of cooking the food. Typical applications relate to the use of fans driven by electric motors. In this field there is a need to be able to vary the rotation speed of the fan in order to control the temperature inside the cooking chamber, according to the cooking cycles required. One type of known regulating system provides for the use of inverter devices, which however prove to be particularly troublesome in the range of apparatuses to which the invention is addressed. Other known types provide for "wave-cut" systems or "multi-winding" motors, these systems also proving rather expensive in relation to the functional character required in the respective applications. Moreover, such systems often have characteristics and degrees of accuracy in the regulation of the fan speed which are rather high, and which prove unjustified in relation to the temperature gradients which are in any case acceptable in the cooking cycles, and having much wider tolerances than those ensured by the aforesaid systems. In addition, the aforesaid regulating devices in any case involve dispersions of thermal energy, more or less significant, which however have a negative effect on the thermal balance of the cooking apparatus.

Another known system provides for the use of electric motors in which the speed variation is obtained by connecting one or more electrical resistors in series with the motor. By means of the electrical supply of such resistors, corresponding reductions in the rotation speed of the motor are obtained. These systems however, although proving to be simpler than those previously mentioned, involve the limitation of the dispersion of thermal energy, produced in the electrical resistors as the current passes through, with a consequent lower overall output of the apparatus.

SUMMARY

The main aim of the invention is that of providing a cooking oven for foods which is structurally and functionally designed so as to make it possible to remedy the limitations mentioned with reference to the prior art cited.

This aim is achieved by the invention by a cooking oven for foods which is produced according to the following claims.

BRIEF DESCRIPTION OF THE DRAWING

Further features and advantages of the invention will become clearer from the following detailed description of a preferred exemplary embodiment thereof, illustrated by way of non-limiting example with reference to the appended drawing, which is a schematic view of a cooking oven produced according to the invention.

With reference to the drawing, the reference 1 indicates as a whole and shows only schematically, a cooking oven for foods, produced according to the present invention.

DETAILED DESCRIPTION OF THE PREFERRED EMBODIMENTS

Figure 1:
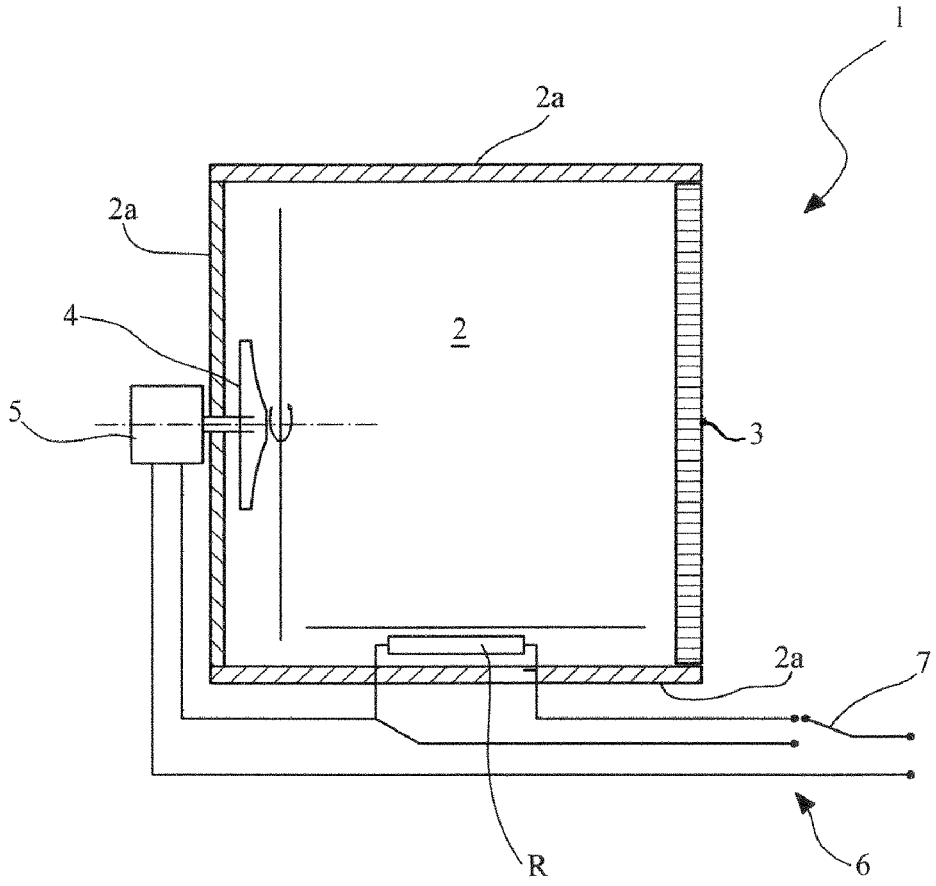

The oven 1 is provided with a cooking chamber 2 inside which the foods to be cooked can be received. Said chamber is bounded by walls 2*a* having suitable thermal insulation characteristics impeding the dissipation of the heat generated within the chamber. The reference 3 indicates a door for access to the cooking chamber for the introduction and removal of the foods being cooked.

The oven 1 is also provided with heat-generator, not shown, for example including a plurality of electrical resistors, with which the temperature inside the chamber 2 is controlled in the pre-set cooking cycle. In order to regulate the course of the temperature, a fan 4 is also provided, driven in rotation by an electric motor 5, arranged within the cooking chamber, and the function of which is to provide forced air circulation, suitable for ensuring the pre-set cooking process.

The motor 5 is fed by an electrical circuit, indicated overall by 6, to which an electrical resistor R is connected in series.

The motor can be supplied electrically with the resistor R inserted or not inserted, by the use of a switch 7, shown schematically in FIG. 1.

According to a principal feature of the invention, the resistive element R is disposed within the cooking chamber 2, so that the heat generated by the passage of electric current, with the resistor R supplied with power, is not dispersed but is instead recovered in a suitable manner and also directed and maintained within the cooking chamber itself. This heat advantageously adds to the heat generated within the chamber during the cooking stage and can reasonably counter the dissipation of thermal energy which has passed through the walls 2*a* of the oven.

In operation, when a reduction in the number of revolutions of the fan is required, the resistor R is inserted into the operating circuit of the motor, by switching the switch 7 of the circuit to supply power to the resistor R in series with the motor 5. The insertion of the resistor R entails a reduction in the number of revolutions of the motor 5 and a consequent reduction in the speed of the fan 4. This variation entails a corresponding reduction in the circulation of air within the cooking chamber, suitable for ensuring the cooking cycle envisaged for a preselected food.

In this phase the recovery of the heat emitted in the region of the resistor R is advantageously obtained, which heat is not dispersed into the atmosphere but is maintained within the cooking chamber, favouring the thermal balance of the chamber itself. At the same time, there is less dissipation of thermal energy at the motor, running at a rotation speed below the rated rotation speed.

The recovery of thermal energy at the resistor R counters the dissipation of energy through the walls 2*a* of the oven, with a consequently greater thermal efficiency of the oven.

The use of the system for regulating the speed of the fan with the resistor R, also makes it possible to reduce significantly the starting currents in the starting-up phase of the motor 5, when the resistor is inserted on starting up.

In an alternative embodiment of the invention it is possible to provide a pair of resistors electrically connected in series with each other and also with the motor, in such a way that only one or both of them may be supplied with power in the circuit 6. When the resistors are selected to be the same as each other the connection to the motor of one or both of the resistors offers the advantage of having available at least two different speed levels in addition to the rated speed of the motor. As a further alternative, when the two resistors are of different sizes from each other, the possibility of supplying power to one or the other of the resistors or to both simultaneously in series with the motor offers the advantage of having available at least three different speed levels, in addition to the rated speed of the motor.

The invention thus achieves the aims proposed, obtaining the advantages compared with the known solutions.

A principal advantage lies in the fact that by the system for regulating the speed by the use of an electrical resistor, that can be selectively supplied with power in series in the operating circuit of the motor, it is possible to obtain the recovery of the heat generated by the resistor, favouring the thermal balance of the oven, this solution proving to be simple in construction, with limited costs, while ensuring adequate regulation of the thermal characteristic of the oven in the cooking process.

What is claimed is:

1. A cooking oven, comprising a cooking chamber, a variable speed electric fan arranged for generating forced ventilation of the air inside said chamber, a regulating system for regulating the speed of the motor of said electric fan including at least one resistive electric element in the electrical supply circuit of the motor, in order to obtain the variation of the speed of the fan as a result of the electrical supply of said resistive element, wherein said at least one resistive element is provided inside the cooking chamber of the oven, so that the heat generated by the resistive element is recovered and maintained within the cooking chamber in the thermal balance of said chamber, during the cooking of the foods.

2. A cooking oven according to claim 1, wherein said at least one resistive element comprises a resistor connected in series with the motor and capable of being selectively inserted into or disconnected from the circuit by the actuation of a switch arranged in said circuit.

3. A cooking oven according to claim 1, wherein at least two electrical resistors are provided, connectable in series with the motor, in combination with one another or alternatively one to the other, so as to obtain a variation in the speed of the motor at least two different levels.

4. A cooking oven according to claim 3, wherein the electrical resistances of said pair of resistors are equal to each other.

5. A cooking oven according to claim 3, wherein the electrical resistances of said pair of resistors are different from each other, so that in series connection with the motor, in combination with each other or alternatively one to the other, respective different speeds of rotation of the motor are obtained.

* * * * *